United States Patent [19]

Stotler

[11] 4,104,758

[45] Aug. 8, 1978

[54] CREDIT CARD WASHING DEVICE

[76] Inventor: James L. Stotler, 11243 McKinney Ave., Detroit, Mich. 48224

[21] Appl. No.: 784,133

[22] Filed: Apr. 4, 1977

[51] Int. Cl.[2] ..... A46B 11/00; B08B 1/00

[52] U.S. Cl. ..... 15/104.92; 15/117; 15/160

[58] Field of Search ..... 15/21 A, 21 B, 38, 39, 15/77, 102, 104.92; 15/117

[56] References Cited

U.S. PATENT DOCUMENTS

| | | | |
|---|---|---|---|
| 1,244,469 | 10/1917 | Chartier | 15/39 |
| 3,102,291 | 9/1963 | Frater | 15/21 A |
| 3,150,406 | 9/1964 | Obitts | 15/104.92 |
| 3,156,000 | 11/1964 | Westhoff | 15/104.92 |
| 3,224,029 | 12/1965 | Domingos | 15/104.92 |
| 3,378,873 | 4/1968 | Strout | 15/104.92 X |
| 3,428,988 | 2/1969 | Blackburn | 15/104.92 X |
| 3,761,984 | 10/1973 | Hauschild | 15/39 |
| 3,800,349 | 4/1974 | Green | 15/102 X |

FOREIGN PATENT DOCUMENTS

| | | | |
|---|---|---|---|
| 749,864 | 5/1933 | France | 15/77 |
| 290,641 | 8/1928 | United Kingdom | 15/39 |

*Primary Examiner*—Daniel Blum

*Attorney, Agent, or Firm*—Basile and Weintraub

[57] ABSTRACT

A device for washing credit cards comprising an enclosed housing having an inlet aperture through which a credit card holder is insertable for positioning the credit card into a cleaning fluid contained within the housing. Scrubbing brushes submerged in the cleaning fluid within the housing receive the credit card for cleaning the same. The credit card holder is reciprocated with respect to the scrubbing brushes to effect cleaning of the credit card. The housing also functions as a clipboard to hold the charge receipts while the same is being signed by the credit card user.

5 Claims, 5 Drawing Figures

CREDIT CARD WASHING DEVICE

BACKGROUND OF THE INVENTION

I. Field of the Invention

The present invention relates to a washing device for credit cards and the like and more particularly, to a portable device for washing credit cards of the type used for the purchase of petroleum products.

II. Description of the Prior Art

Numerous devices, apparatuses and machines for cleaning and drying various materials are generally known in the art. Examples of the variety of cleaning apparatuses that are known are disclosed in the U.S. Pat. Nos. 3,938,213; 3,970,471; 3,740,784; 3,333,291; 2,952,741; 3,008,161; 3,117,333; and 3,237,231.

The use of credit cards for the purchase of petroleum products, such as gasoline, oil and the like, is a common occurrence. It is well known that the use of such credit cards at service stations generally results in the return of a soiled card to the user, as the attendants generally have grease on their hands which is easily and simply transferred to the credit card to the general annoyance and possible inconvenience of the credit card user whose hands or clothes may also become soiled from handling the credit card. It would therefore be desirable to provide a simple and inexpensive device for removing the soiled matter from plastic credit cards, the same being accomplished with a device which is portable, of light weight and simple to use.

SUMMARY OF THE INVENTION

The present invention, which will be described subsequently in greater detail, comprises a portable device for the simple and inexpensive cleaning of plastic credit cards. The device comprises an enclosed housing having a liquid-holding portion within which is submerged a pair of brushes which are engaged in a reciprocating-like fashion with the credit card to effect cleaning thereof.

It is therefore a primary object of the present invention to provide a new and improved credit card washing device which is simple in its design, convenient to use and economical to manufacture and maintain.

It is a further object of the present invention to provide a credit card washing device of the type disclosed herein which may be used in a quick and easy manner for cleaning soiled, plastic credit cards.

Other objects, advantages and applications of the present invention will become apparent to those skilled in the art of washing devices when the following description of one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
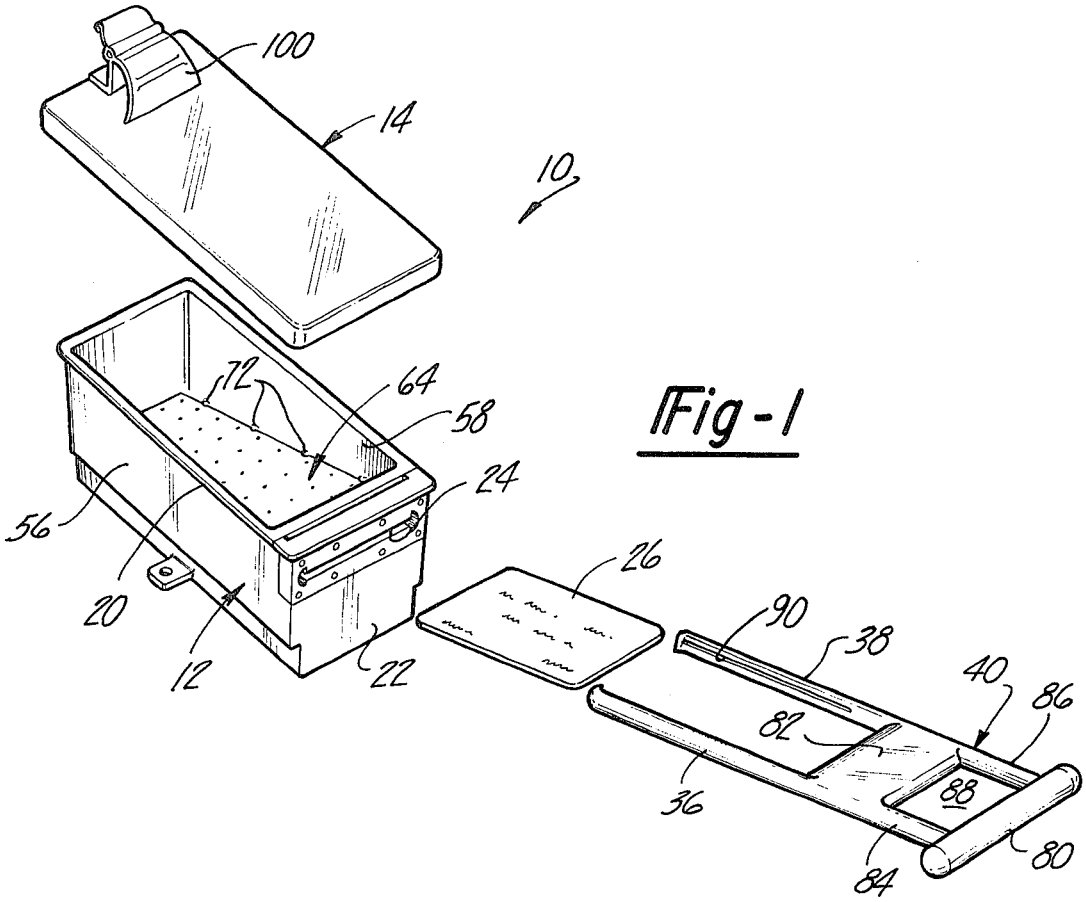
FIG. 1 is a partially exploded, perspective view of a credit card washing device constructed in accordance with the principles of the present invention.

Referring now to the drawings and, in particular, to FIG. 1 wherein there is illustrated one example of the present invention in the form of a credit card washing device 10. The credit card washing device 10 comprises a housing 12 enclosed by a cover 14. The cover 14 has an outer flange 16 (FIG. 3) provided with an internal groove 18. The upper peripheral edge of the housing 12 has a bead or lip 20 that is adapted to snap lockingly engage the flange groove 18 to secure the cover 14 to the housing 12 and to enclose the interior of the housing 12. One end face 22 of the housing 12 is provided with an aperture 24 through which a credit card 26 may be inserted for the purpose of cleaning the credit card 26 in a manner which will be described in greater detail hereinafter.

Figure 2:
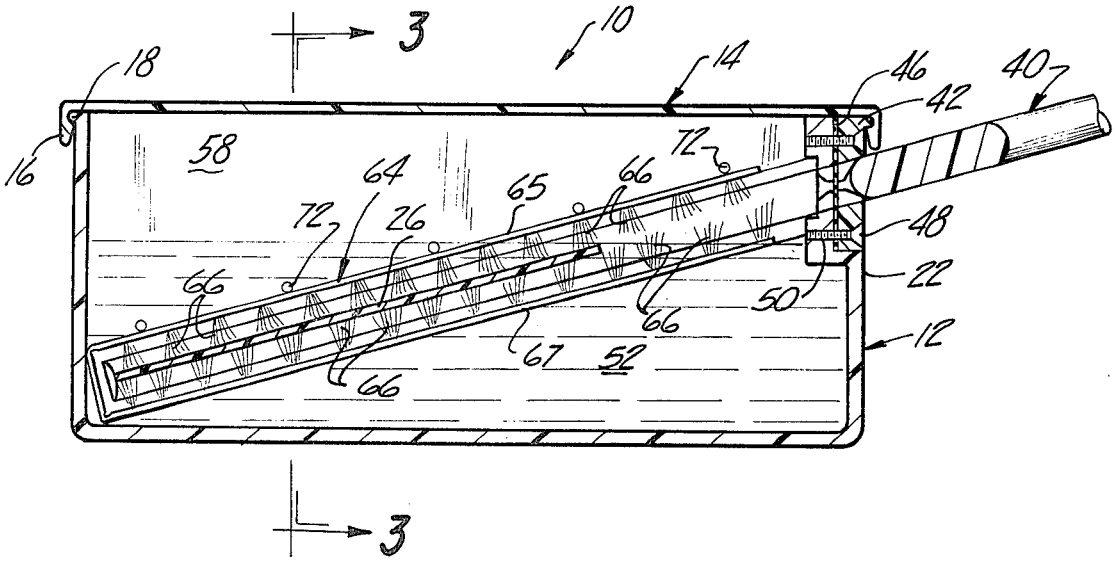
FIG. 2 is a longitudinal sectional view of the credit card washing device taken along Line 2—2 of FIG. 3.
Figure 5:
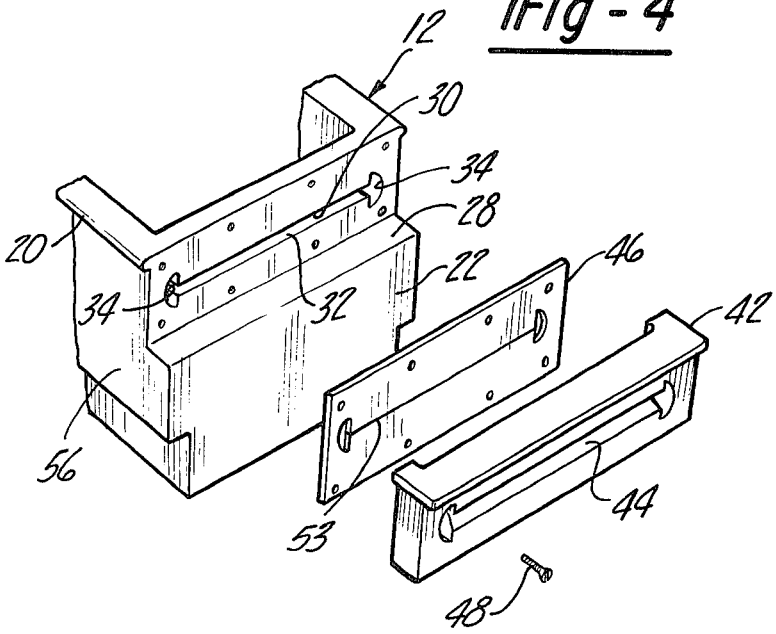
FIG. 5 is a fragmentary exploded, perspective view of the inlet aperture and sealing element utilized in the credit card washing device illustrated in FIGS. 1 through 3 of the drawings.

As can best be seen in FIGS. 2 and 5, the end face 22 has an upper portion which is recessed at 28 and wherein an I-shaped slot 30 is formed. The I-shaped slot 30 extends completely through the face 22 and is sized at its midsection 32 so as to receive the card 26 and to permit its passage therethrough. The opposite ends 34 of the slot 30 have semi-circular shapes which are complementary to the peripheral shape of the legs 36 and 38 of a credit card holder 40, all of which will be described in detail hereinafter. The recess 28 supports a slotted molding 42 which has an I-shaped slot 44 that is shaped and sized to be complementary to the face aperture or slot 30. A resilient seal, such as a rubber squeegee, 46 is sandwiched between the end face 22 and the inside surface of the molding 42, while fasteners, such as screws 48, extend through the molding 42 and engage threaded bores 50 formed in the end face 22 so as to securely attach the molding 42 to the end face 22 while securing the seal 46 thereinbetween. The seal 46 functions as a means for preventing cleaning fluid 52 from inadvertently being released from the housing 12, as the seal lips 53 are normally closed to prevent the passage of fluid therefrom. The lips 53, however, are resilient in nature and permit the card 26 to be inserted therethrough in a manner to be described hereinafter. The seal 46 may be made of any suitable resilient product, such as rubber, and functions to wipe the card 26 clean when it is removed from the housing.

Figure 3:
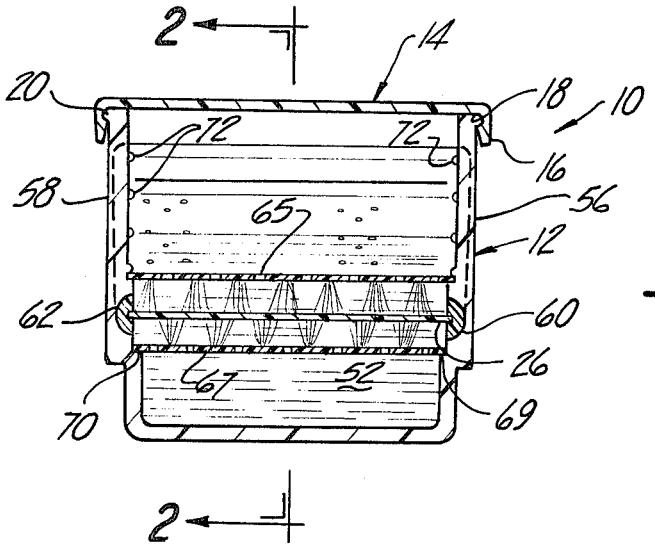
FIG. 3 is a cross sectional view of the credit card washing device taken along Line 3—3 of FIG. 2.

Referring now to FIGS. 1, 2 and 3, it can be seen that the opposite side walls 56 and 58 are respectively provided with semi-circularly shaped and longitudinally inclined guideways 60 and 62, which are adapted to receive the legs 36 and 38 of the card holder 40 to guide the card holder 40 for reciprocal movement within the interior of the housing 12 in a manner which will be described hereinafter.

Figure 4:
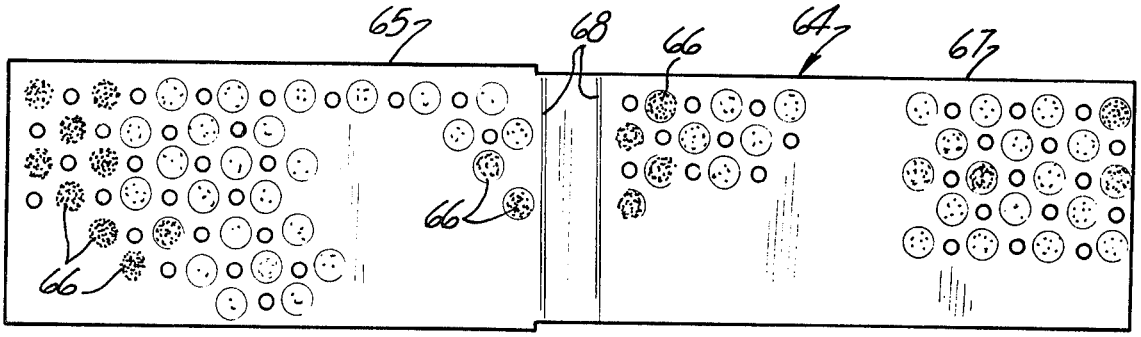
FIG. 4 is a plan view of the scrubbing brushes utilized in the credit card washing device illustrated in FIGS. 1 through 3 of the drawings.

Referring to FIG. 4, there is illustrated an example of a scrubbing brush 64 in the form of a molded item having a plurality of bristles 66 and wherein the left-hand portion 65 of the molded brush 64 is slightly larger than the right-hand portion 67. The brush 64 has flexible sections 68 which permit two portions of the brush 64 to be folded toward one another to define the U-shaped element, as illustrated in FIGS. 2 and 3 of the drawings. The U-shaped brush 64 is positioned within the housing 12 and disposed along an incline that parallels the axes of the guideways 60 and 62. As can be seen in FIG. 3, the inside surfaces of the side walls 56 and 58 are, respectively, provided with steps 69 and 70 which are sized to receive and support the smaller right hand portion 67 of the brush 64. The larger portion 65 is similarly supported by a ledge. The inside surfaces of the side walls 56 and 58 are further provided with a plurality of locking projections 72 which left hand snap lockingly engage the upper surface of the larger portion 65 to securely mount the molded scrub brush 64 within the housing 12 in a position which parallels the axes of the card holder guideways 60 and 62.

Referring now to FIG. 1, the credit card holder 40 is illustrated as comprising a handle portion 80 which is connected to a body 82 so as to define between the legs 84 and 86 an opening 88 in which the hand of the user may be inserted when grasping the handle 80. The legs 36 and 38 of the holder 40 extend outwardly from the body 82 in a cantilever fashion such that the legs 36 and 38 are slightly flexible for movement toward and away from each other. The inside or opposing surfaces of the legs 36 and 38 are provided with recesses 90 sized to receive the outer edges of the credit card 26 so as to securely attach the credit card 26 between the legs 36 and 38 of the holder 40. The outside surfaces of the holder legs 36 and 38 have a circular configuration complementary to the circular configuration of the slot ends 34 and the guideways 60 and 62. It can thus be seen that when the credit card 26 is within the recesses 90 of the holder 40, that is, between the legs 36 and 38 of the holder 40, and the leg end of the holder 40 is inserted through the housing aperture or slot 30, the card 26 will be inserted into the housing 12 and along a direction paralleling the guideways 60 and 62 whereby the credit card 26 is inserted between the scrubbing bristles 66. As can be seen in FIG. 2, since the scrubbing brushes are substantially under the cleaning fluid 52, the reciprocal movement of the holder 40 by the user will reciprocate the credit card 26 back and forth between the bristles 66 thereby effecting a cleaning action to remove any dirt that may be on the credit card 26.

It should be noted upon inspection of FIG. 3 of the drawings that the guideways 60 and 62 are tapered toward one another as they approach the bottom of the housing 12. This tapering of the guideways 60 and 62 exerts an inward force on the legs 36 and 38 of the holder 40 to ensure a tighter grip of the credit card 26 as the same is reciprocated within the housing between the bristles 66.

The housing 12, the cover 14 and the holder 40 may all be fabricated from a plastic and be molded by any one of several known molding techniques, such as vacuum molding or injection molding, as desired. Similarly, the brush 64 is molded from a plastic material. Due to the simple snap lockingly relationship between the cover 14 and the housing 12, the cleaning fluid 50 may be simply changed when the same becomes dirty from use.

As can be seen in FIG. 1 of the drawings, the top portion of the cover 14 includes a clip 100 for securing the credit card receipt thereto and for functioning as a writing surface to facilitate the signing of the credit card receipt by the user.

It can thus be seen that the present invention has provided a new and unique device for washing credit cards, which device is simple in its construction and design and thus inexpensive to manufacture and maintain, as well as one which may be easily used.

While only one example of the present invention has been disclosed, it should be understood by those skilled in the art of washing devices that other forms of applicant's invention may be had, all coming within the spirit of the invention and scope of the appended claims.

What is claimed is as follows:

1. A device for washing credit cards and the like, said device comprising:

an enclosed housing having an aperture, said housing having a liquid holding portion below said aperture;

brush means disposed in said liquid holding portion;

a holder for supporting a credit card, said holder being insertable through said aperture;

means guiding said holder to said brush means to facilitate the cleaning of said credit card when disposed between said brush means; said holder having a body portion and handle means extending from said body portion to facilitate the gripping of said holder by a user; and a pair of leg members extending outwardly from said holder, said leg members each having opposing longitudinal slots for receiving and supporting a credit card, the outer peripheries of said leg members having circular configurations; said legs being movable toward and away from each other; the interior walls of said housing defining said guiding means in the form of slotted portions defining guideways respectively receiving said leg members of said holder to guide said holder toward and away from said brush means; said guideways having a tapered path such that said legs are urged toward one another to tightly grip said card as said holder is inserted within said housing.

2. The device defined in claim 1 wherein said brush means comprises upper and lower opposing brushes disposed along an axis which parallels the axes of said guideways for receiving said card thereinbetween to effect cleaning of said card as said holder is reciprocally moved within said housing.

3. The device defined in claim 2 wherein said guideways are disposed along an inclined axis extending from said aperture down toward the bottom of said housing, said housing being filled with a cleaning fluid to a level below said housing aperture.

4. The device defined in claim 1 wherein the outer periphery of said housing defines a lip;

a cover having a peripheral flange with an interior recess sized to snap lockingly engage said housing lip to secure said housing cover to said housing; and fastening means attached to the top of said housing for releasably attaching a credit card receipt thereto to facilitate execution of said receipt by a user.

5. The device defined in claim 1 wherein said aperture has a wiper through which said card must extend, said wiper cleaning fluid from said card as said card is withdrawn from said housing.

* * * * *